US011213761B2

(12) United States Patent
Lyell

(10) Patent No.: US 11,213,761 B2
(45) Date of Patent: Jan. 4, 2022

(54) COMFORTING DEVICE

(71) Applicant: Mary M. Lyell, Alexandria, IN (US)

(72) Inventor: Mary M. Lyell, Alexandria, IN (US)

( * ) Notice: Subject to any disclaimer, the term of this patent is extended or adjusted under 35 U.S.C. 154(b) by 0 days.

(21) Appl. No.: 16/854,569

(22) Filed: Apr. 21, 2020

(65) Prior Publication Data

US 2021/0322889 A1 Oct. 21, 2021

(51) Int. Cl.

| | |
|---|---|
| ***A63H 3/28*** | (2006.01) |
| ***A63H 3/02*** | (2006.01) |
| ***A63H 3/00*** | (2006.01) |
| ***A63H 3/36*** | (2006.01) |

(52) U.S. Cl.

CPC ..... *A63H 3/001* (2013.01); *A63H 3/02* (2013.01); *A63H 3/28* (2013.01); *A63H 3/36* (2013.01)

(58) Field of Classification Search

CPC ..... A63H 3/001; A63H 3/003; A63H 3/02; A63H 3/28; A63H 3/36; A61M 2021/0061

USPC ..... 446/295, 297, 369

See application file for complete search history.

(56) References Cited

U.S. PATENT DOCUMENTS

| | | | | | |
|---|---|---|---|---|---|
| 3,563,229 | A * | 2/1971 | Petrusson | A61M 21/00 | 600/28 |
| 3,888,233 | A * | 6/1975 | Ware | H03K 3/2828 | 600/28 |
| 4,575,351 | A * | 3/1986 | Gonzalez | A63H 3/003 | 434/256 |
| 4,718,876 | A * | 1/1988 | Lee | A61M 21/00 | 446/295 |
| 4,968,281 | A * | 11/1990 | Smith | A63H 3/02 | 446/369 |
| 6,325,695 | B1 * | 12/2001 | Weiner | A61F 7/007 | 446/295 |
| 6,488,561 | B2 * | 12/2002 | Weiner | A61F 7/007 | 219/201 |
| 6,511,361 | B2 * | 1/2003 | Koike | A63H 3/36 | 446/369 |
| D483,818 | S | 12/2003 | Lewis | | |
| 6,939,195 | B1 * | 9/2005 | Hunt | A63H 3/001 | 446/295 |
| 10,314,292 | B2 * | 6/2019 | Thorne | A01K 27/002 | |
| 10,792,578 | B2 * | 10/2020 | Su | G06F 1/1632 | |
| 2007/0212974 | A1 * | 9/2007 | Brewer | A63H 3/02 | 446/369 |
| 2007/0227463 | A1 * | 10/2007 | Polito | A01K 1/0218 | 119/707 |
| 2009/0013473 | A1 * | 1/2009 | Williams | A47D 13/02 | 5/655 |
| 2009/0156089 | A1 * | 6/2009 | Hoard | A63H 3/001 | 446/297 |
| 2012/0238178 | A1 * | 9/2012 | Wadhwani | A63H 3/02 | 446/72 |
| 2015/0112121 | A1 * | 4/2015 | Eyrun | A63H 3/02 | 600/28 |

(Continued)

*Primary Examiner* — Alexander R Niconovich

(57) ABSTRACT

A comforting device for soothing and comforting a user includes a shell, which defines an interior space. The shell is pliable and can be grasped by the user. A filler, which is resiliently compressible, is positioned in and substantially occupies the interior space. An audio module, which is positioned in the interior space, selectively emits a first sound, which mimics a heartbeat, and a second sound, which mimics a respiratory sound, such as breath sounds and snoring. The audio module broadcasts the first sound and the second sound to comfort the user.

12 Claims, 5 Drawing Sheets

(56) References Cited

U.S. PATENT DOCUMENTS

| | | | | |
|---|---|---|---|---|
| 2015/0133022 | A1* | 5/2015 | Ushiba | A63H 3/02 446/73 |
| 2016/0158658 | A1* | 6/2016 | Lakritz | A61J 17/1111 446/71 |
| 2017/0120155 | A1* | 5/2017 | Nicholls | A61M 21/00 |
| 2018/0318129 | A1* | 11/2018 | Kang | A63H 3/003 |

* cited by examiner

COMFORTING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to comforting devices and more particularly pertains to a new comforting device for soothing and comforting a user.

(2) Description of Related Art Including Information Disclosed Under 37 CFR 1.97 and 1.98

The prior art relates to comforting devices. Prior art comforting devices may comprise stuffed animals configured to emit pulsating sounds and sounds for entertainment.

BRIEF SUMMARY OF THE INVENTION

An embodiment of the disclosure meets the needs presented above by generally comprising a shell, which defines an interior space. The shell is pliable and thus is configured to be grasped by a user. A filler, which is resiliently compressible, is positioned in and substantially occupies the interior space. An audio module is positioned in the interior space and is configured to selectively emit a first sound, which mimics a heartbeat, and a second sound, which mimics a respiratory sound, such as breathing sounds and snoring. The audio module is configured to broadcast the first sound and the second sound to comfort the user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
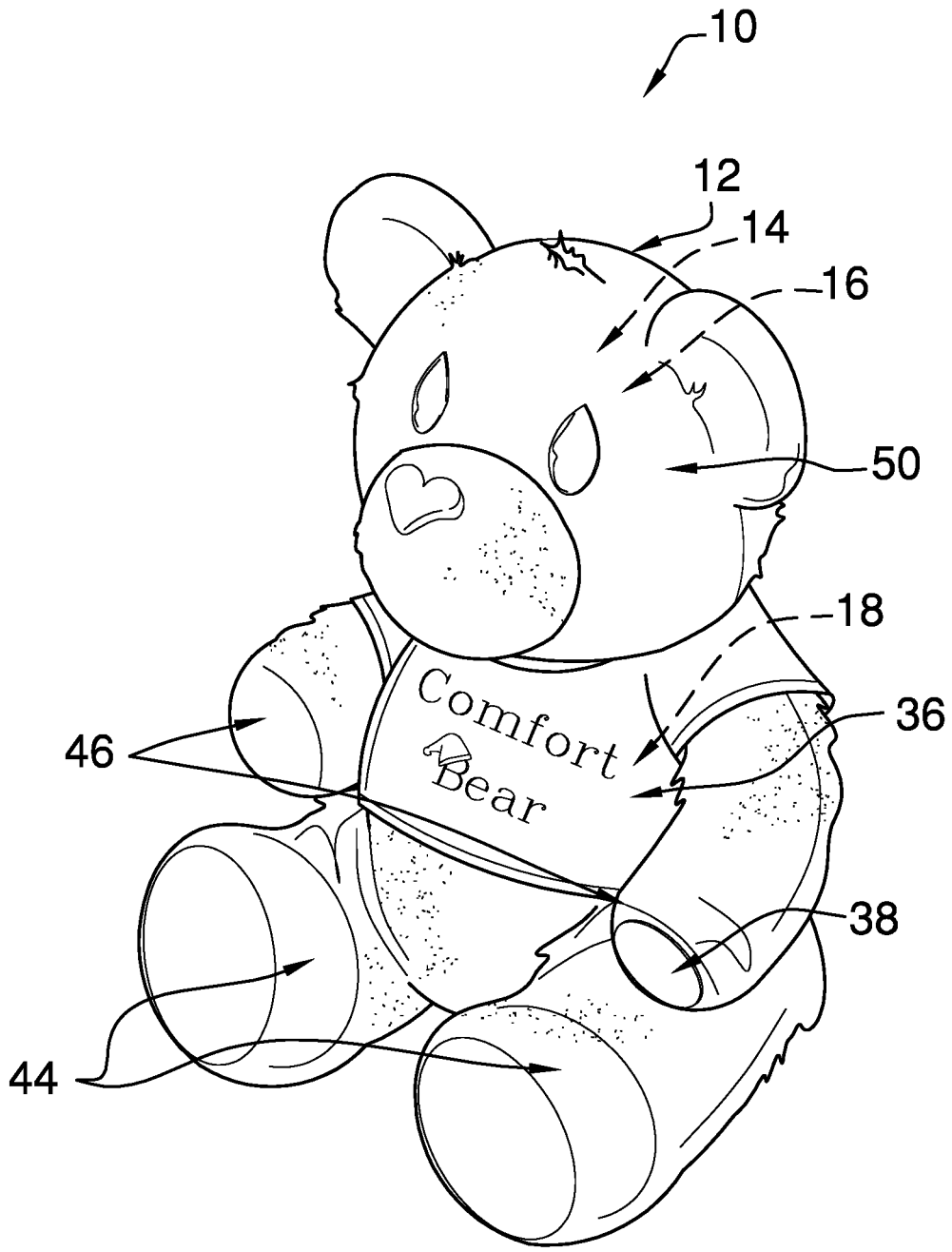
FIG. 1 is an isometric perspective view of a comforting device according to an embodiment of the disclosure.

With reference now to the drawings, and in particular to FIGS. 1 through 5 thereof, a new comforting device embodying the principles and concepts of an embodiment of the disclosure and generally designated by the reference numeral 10 will be described.

As best illustrated in FIGS. 1 through 5, the comforting device 10 generally comprises a shell 12, which defines an interior space 14. The shell 12 is pliable and thus is configured to be grasped by a user. The shell 12 comprises fabric. The shell 12 may comprise at least one of cotton, microfiber cloth, and the like. The shell 12 may be animal shaped. For example, the shell 12 may teddy bear shaped, as shown in FIGS. 1-5. A filler 16, which is resiliently compressible, is positioned in and substantially occupies the interior space 14.

An audio module 18 is positioned in the interior space 14 and is configured to selectively emit a first sound, which mimics a heartbeat, and a second sound, which mimics a respiratory sound, such as breathing sounds and snoring. The audio module 18 is configured to broadcast the first sound and the second sound to comfort the user.

Figure 5:
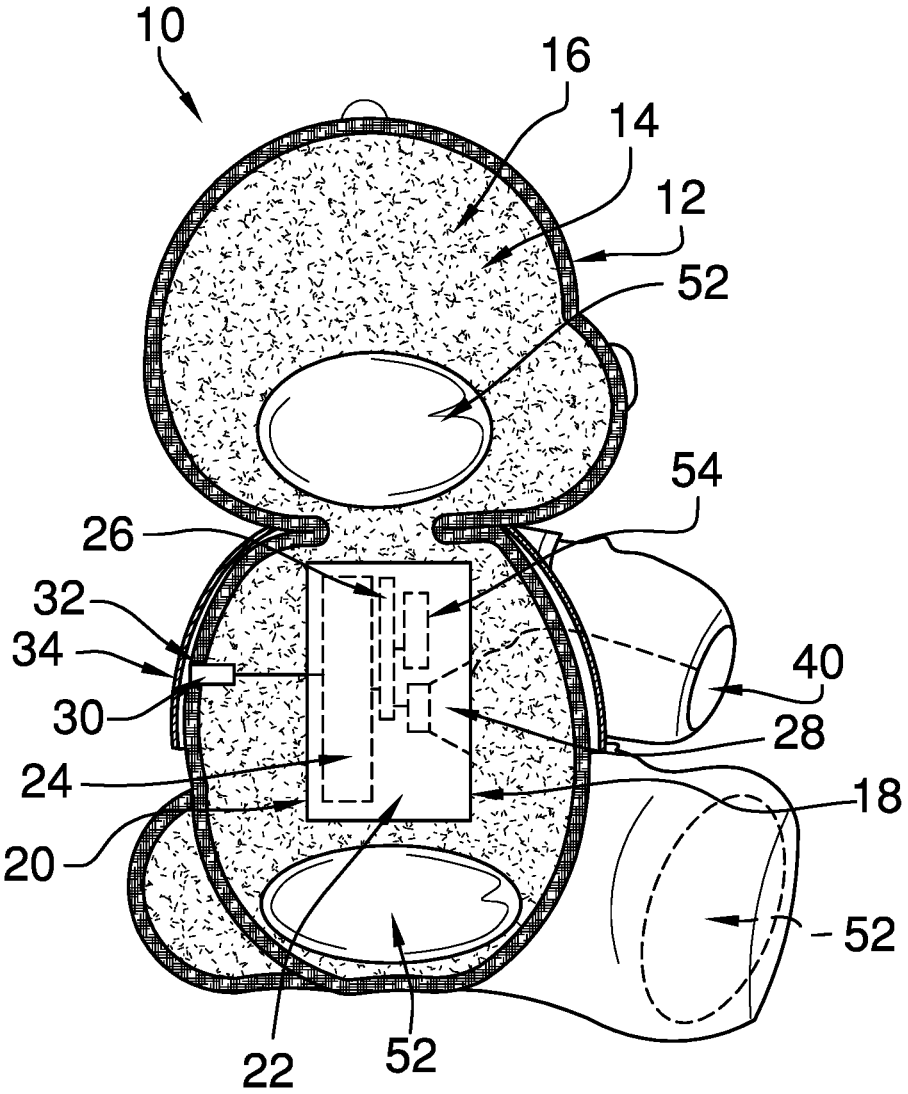
FIG. 5 is a cross-sectional view of an embodiment of the disclosure.

The audio module 18 comprises a housing 20, which defines an internal space 22, as shown in FIG. 5. A battery 24, a microprocessor 26, and a speaker 28 are engaged to the housing 20 and are positioned in the internal space 22. The microprocessor 26 is operationally engaged to the battery 24 and the speaker 28. The microprocessor 26 is positioned to selectively actuate the speaker 28 to broadcast the first sound and the second sound. The present invention anticipates a pulsating vibrator 54 engaged to the housing 20 and positioned in the internal space 22. The pulsating vibrator 54 is operationally engaged to the microprocessor 26 and is configured to emit the first sound.

The battery 24 may be rechargeable. A port 30 is engaged to the housing 20 and is operationally engaged to the battery 24. The port 30 is configured to engage a charging cord (not shown) to operationally engage the battery 24 to a source of electrical current to charge the battery 24. The present invention also anticipates the battery 24 being replaceable.

Figure 4:
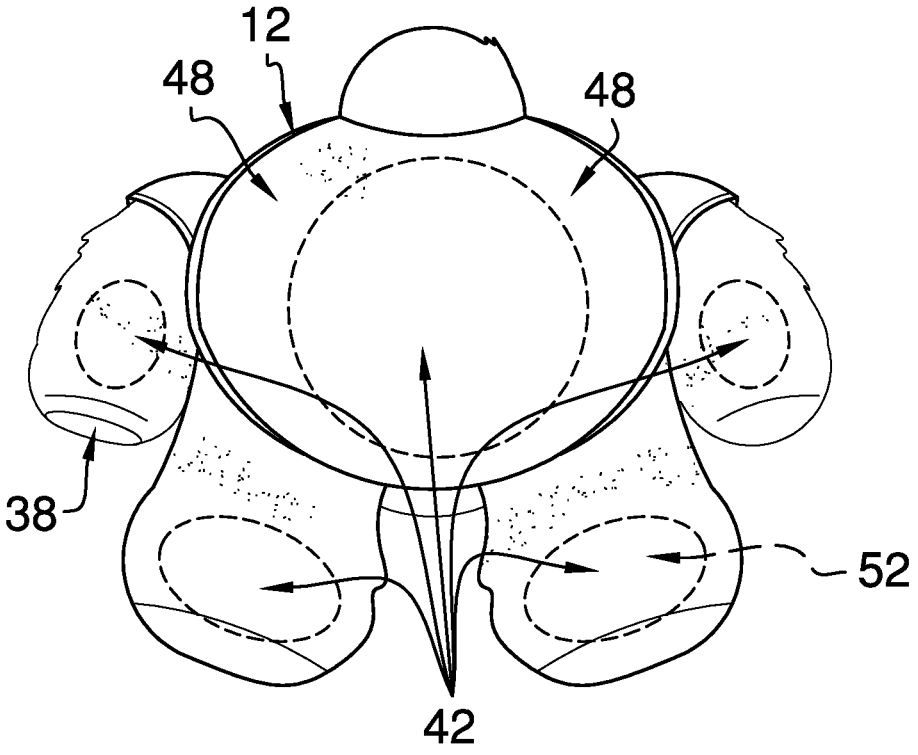
FIG. 4 is a bottom view of an embodiment of the disclosure.

The shell 12 has an aperture 32 positioned therein proximate to the housing 20. The aperture 32 is configured to allow access the port 30. A flap 34 is engaged to the shell 12 proximate to the aperture 32 and is configured to selectively engage the shell 12 so that the flap 34 covers the aperture 32, as shown in FIG. 4. The flap 34 may be selectively engaged to the shell 12 using a variety of engaging means, such as, but not limited to, zippers, hook and loop fasteners, snap fasteners, and the like. A t-shirt 36 may be positioned on the shell 12 to cover the flap 34.

A controller 38 is engaged to the shell 12 and is operationally engaged to the microprocessor 26. The controller 38 is positioned to modulate at least one parameter of at least one of the first sound and the second sound. For example, the controller 38 may modulate a volume or a tempo of the first sound to mimic a variety of heartbeats. The controller 38 also may modulate a volume or content of the second sound to provide, for example, loud snoring, soft snoring, deep breathing sounds, or normal breathing sounds.

Figure 2:
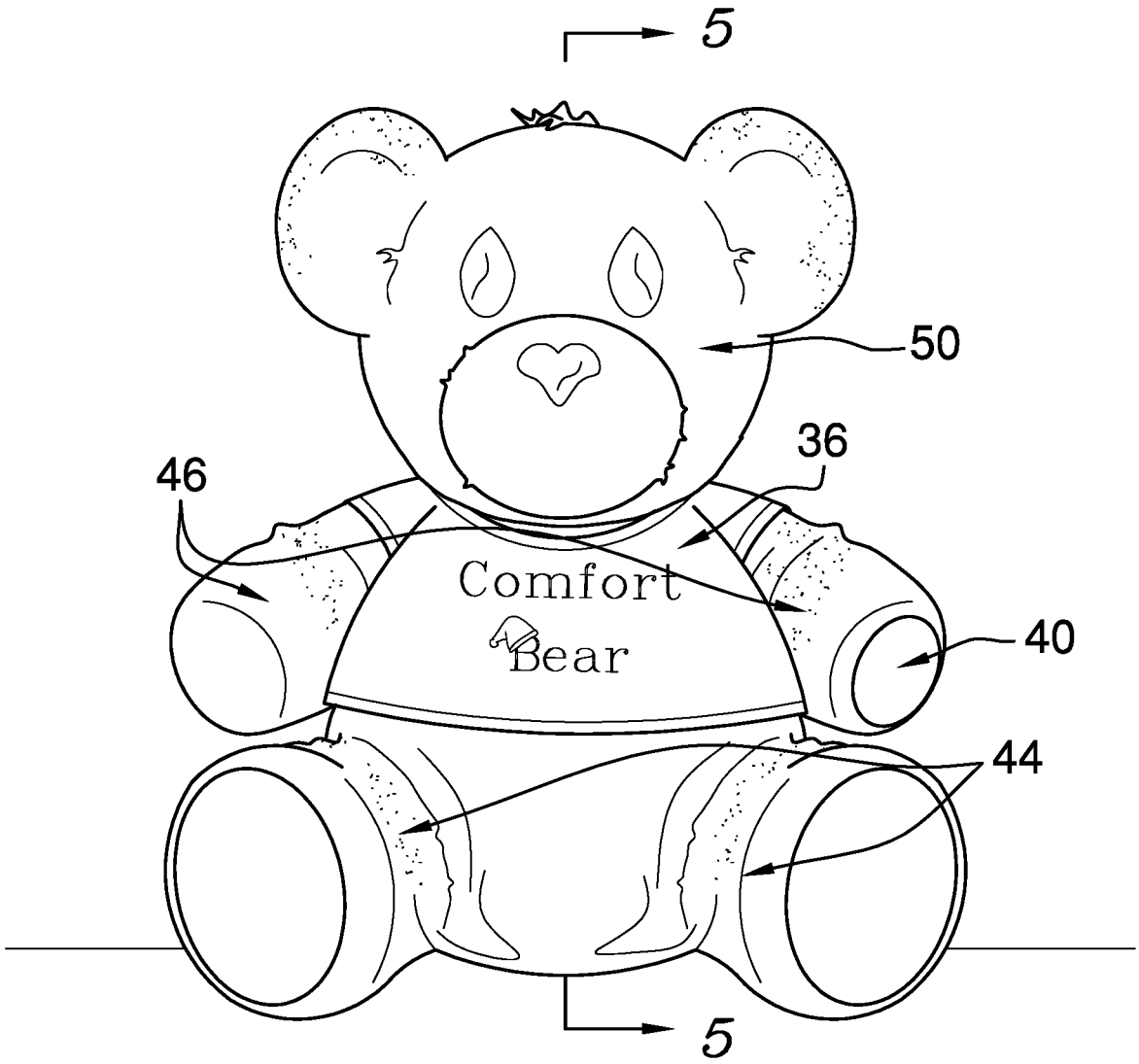
FIG. 2 is a front view of an embodiment of the disclosure.

The controller 38 may comprise a button 40, which is depressible, as shown in FIG. 2. The button 40 is configured to be depressed to modulate at least one parameter of the second sound. The present invention anticipates the controller 38 comprising other controlling means, such as, but not limited to, slide switches, selector switches, touch enabled panels, and the like.

Figure 3:
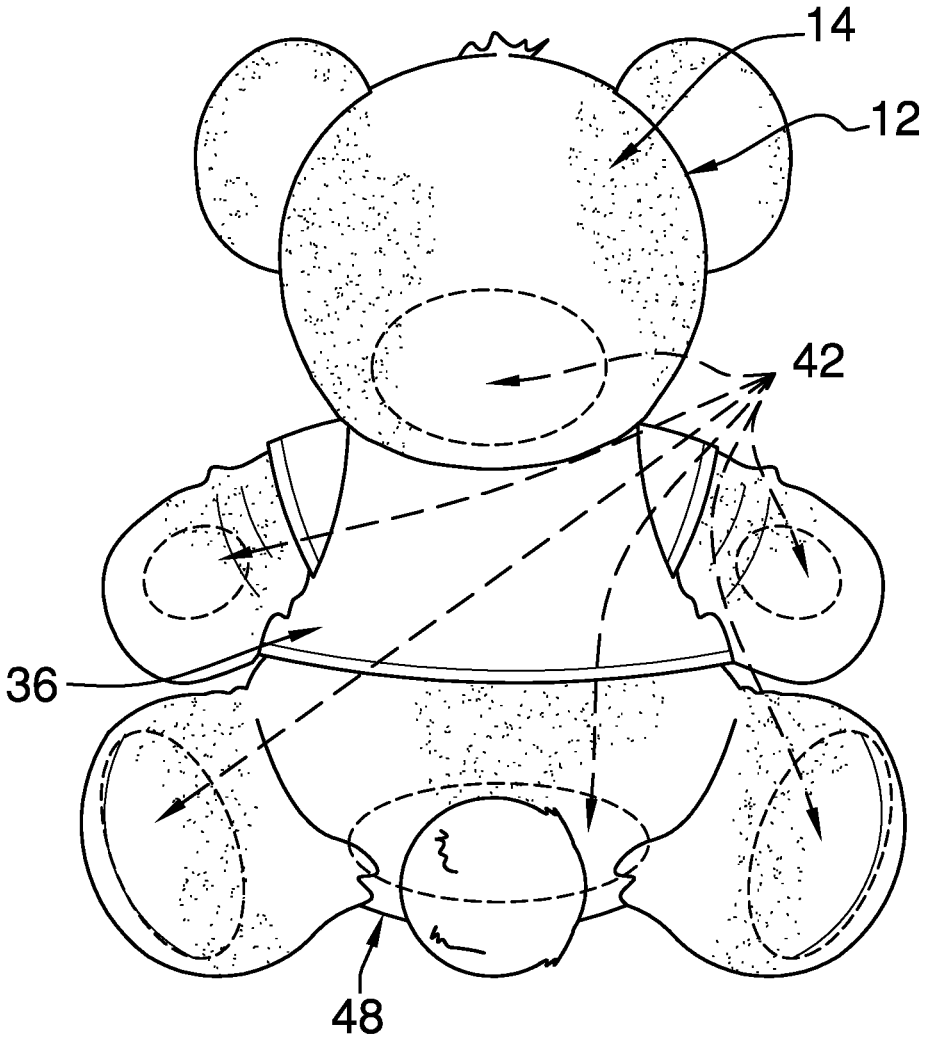
FIG. 3 is a back view of an embodiment of the disclosure.

A plurality of ballasts 42 is engaged to the shell 12 and is positioned in the interior space 14. The ballasts 42 are configured to weight the shell 12. The mass of the shell 12 bearing on the user can provide a sense of companionship, which is beneficial in a variety of circumstances, such as loss of a loved one, separation, and the like. The plurality of ballasts 42 may comprise ballasts 42 that are positioned in legs 44, arms 46, a rump 48, and a head 50 of the shell 12, as shown in FIG. 3. Each ballast 42 may comprise a sandbag 52, or other weighting means, such as, but not limited to, gel filled bladders, metal ball filled bags, and the like.

In use, the shell 12 is grasped by the user and broadcast of the first sound and the second sound is initiated and controlled via the controller 38.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. A comforting device comprising:

a shell defining an interior space, the shell being pliable, where in the shell is configured for grasping by a user;

a filler positioned in and substantially occupying the interior space, the filler being resiliently compressible;

an audio module positioned in the interior space and being configured for selectively emitting a first sound mimicking a heartbeat and a second sound mimicking a respiratory sound, wherein the audio module is configured for broadcasting the first sound and the second sound for comforting the user;

a plurality of ballasts engaged to the shell and positioned in the interior space, wherein the ballasts are configured for weighting the shell, the plurality of ballasts comprising ballasts positioned in legs, arms, a rump, and a head of the shell, wherein each ballast comprises a sandbag; and wherein said audio module is positioned between the ballasts in the rump and head of the shell whereby the ballasts in the rump and head of the shell are positionable in vertical alignment with the audio module facilitating positioning of the shell in a sitting up position.

2. The comforting device of claim I, wherein the shell comprises fabric.

3. The comforting device of claim 2, wherein the shell comprises at least one of cotton and micro fiber cloth.

4. The comforting device of claim 1, wherein the shell is animal shaped.

5. The comforting device of claim 4, wherein the shell is teddy bear shaped.

6. The comforting device of claim 1, wherein the audio module comprises:

a housing defining an internal space;

a battery engaged to the housing and positioned in the internal space;

a microprocessor engaged to the housing and positioned in the internal space, the microprocessor being operationally engaged to the battery; and a speaker engaged to the housing and positioned in the internal space, the speaker being operationally engaged to the microprocessor, such that the microprocessor is positioned for selectively actuating the speaker for broadcasting the first sound and the second sound.

7. The comforting device of claim 6, further including a pulsating vibrator engaged to the housing and positioned in the internal space, the pulsating vibrator being operationally engaged to the microprocessor, wherein the pulsating vibrator is configured to emit the first sound.

8. The comforting device of claim 6, further including:

the battery being rechargeable; and a port engaged to the housing and being operationally engaged to the battery, wherein the port is configured for engaging a charging cord for operationally engaging the battery to a source of electrical current for charging the battery.

9. The comforting device of claim 8, further including:

the shell having an aperture positioned therein proximate to the housing, wherein the aperture is configured for accessing the port; and a flap engaged to the shell proximate to the aperture and being configured for selectively engaging the shell such that the flap covers the aperture.

10. The comforting device of claim 6, further including a controller engaged to the shell and being operationally engaged to the microprocessor, such that the controller is positioned for modulating at least one parameter of at least one of the first sound and the second sound.

11. The comforting device of claim 10, wherein the controller comprises a button, the button being depressible, wherein the button is configured for being depressed for modulating at least one parameter of the second sound.

12. A comforting device comprising:

a shell defining an interior space, the shell being pliable, wherein the shell is configured for grasping by a user, the shell comprising fabric, the shell comprising at least one of cotton and microfiber cloth, the shell being animal shaped, the shell being teddy bear shaped;

a filler positioned in and substantially occupying the interior space, the filler being resiliently compressible;

an audio module positioned in the interior space and being configured for selectively emitting a first sound mimicking a heartbeat and a second sound mimicking a respiratory sound, wherein the audio module is configured for broadcasting the first sound and the second sound for comforting the user, the audio module comprising:

a housing defining an internal space, a battery engaged to the housing and positioned in the internal space, the battery being rechargeable, a port engaged to the housing and being operationally engaged to the battery, wherein the port is configured for engaging a charging cord for operationally engaging the battery to a source of electrical current for charging the battery, a microprocessor engaged to the housing and positioned in the internal space, the microprocessor being operationally engaged to the battery, a speaker engaged to the housing and positioned in the internal space, the speaker being operationally engaged to the microprocessor, such that the microprocessor is positioned for selectively actuating the speaker for broadcasting the first sound and the second sound, and a pulsating vibrator engaged to the housing and positioned in the internal space, the pulsating vibrator being operationally engaged to the microprocessor, wherein the pulsating vibrator is configured to emit the first sound;

the shell having an aperture positioned therein proximate to the housing, wherein the aperture is configured for accessing the port;

a flap engaged to the shell proximate to the aperture and being configured for selectively engaging the shell such that the flap covers the aperture;

a controller engaged to the shell and being operationally engaged to the microprocessor, such that the controller is positioned for modulating at least one parameter of at least one of the first sound and the second sound, the controller comprising a button, the button being depressible, wherein the button is configured for being depressed for modulating at least one parameter of the second sound;

a plurality of ballasts engaged to the shell and positioned in the interior space, wherein the ballasts are configured for weighting the shell, the plurality of ballasts comprising ballasts positioned in legs, arms, a rump, and a head of the shell, each ballast comprising a sandbag; and wherein said audio module is positioned between the ballasts in the rump and head of the shell whereby the ballasts in the rump and head of the shell are positionable in vertical alignment with the audio module facilitating positioning of the shell in a sitting up position.

* * * * *